US007052333B2

(12) United States Patent
Siracki et al.

(10) Patent No.: US 7,052,333 B2
(45) Date of Patent: May 30, 2006

(54) POWER DISTRIBUTION BLOCK ASSEMBLY

(75) Inventors: Glenn T Siracki, Burton, OH (US); Pascal Godard, St. George Haute Ville (FR); Richard E. Sasso, Jr., South Russell, OH (US); Robert Crozier, Sorbiers (FR)

(73) Assignee: ERICO International Corporation, Solon, OH (US)

( * ) Notice: Subject to any disclaimer, the term of this patent is extended or adjusted under 35 U.S.C. 154(b) by 0 days.

(21) Appl. No.: 10/825,019

(22) Filed: Apr. 15, 2004

(65) Prior Publication Data

US 2005/0233648 A1 Oct. 20, 2005

(51) Int. Cl.
*H01R 11/09* (2006.01)

(52) U.S. Cl. ..... 439/798; 439/910; 439/718

(58) Field of Classification Search ..... 439/723–725, 439/727, 797, 814, 910, 798, 718, 813
See application file for complete search history.

(56) References Cited

U.S. PATENT DOCUMENTS

| | | | | |
|---|---|---|---|---|
| 2,431,999 | A | 12/1947 | Engelhardt | 439/718 |
| 2,764,749 | A | 9/1956 | Aberle | 439/588 |
| 2,991,440 | A | 7/1961 | Kulka | 239/17 |
| D195,623 | S | 7/1963 | Leonardo | D26/1 |
| 3,382,478 | A | 5/1968 | Satterthwait | 439/712 |
| 3,652,977 | A | 3/1972 | Feldberg | 439/724 |
| 3,725,851 | A * | 4/1973 | Linn | 439/798 |
| 3,874,760 | A | 4/1975 | Guthmiller et al. | 439/588 |
| D236,481 | S | 8/1975 | Johnston | D26/5 B |
| 4,214,806 | A | 7/1980 | Kraft | 439/620 |
| 4,382,651 | A | 5/1983 | Klosin et al. | 439/359 |
| 4,513,169 | A | 4/1985 | McGrane | 174/138 F |
| 4,547,627 | A | 10/1985 | McGrane | 174/138 F |
| 4,785,378 | A | 11/1988 | Hinckley et al. | 361/363 |
| D302,420 | S | 7/1989 | McGrane | D13/24 |
| D306,716 | S | 3/1990 | Shimirak | D13/24 |
| D309,664 | S | 7/1990 | McGrane | D13/146 |
| D317,434 | S | 6/1991 | McGrane | D13/133 |
| D317,435 | S | 6/1991 | McGrane | D13/133 |
| D320,381 | S | 10/1991 | McGrane | D13/147 |

(Continued)

FOREIGN PATENT DOCUMENTS

| | | |
|---|---|---|
| EP | 1 107 363 | 6/2001 |

(Continued)

OTHER PUBLICATIONS

*ILSCO* Pocket Guide, Revised Edition 1985, pp. 4 and 6.

(Continued)

*Primary Examiner*—Javaid H. Nasri
(74) *Attorney, Agent, or Firm*—Renner, Otto, Boisselle and Sklar, LLP

(57) ABSTRACT

The terminal block assembly of this invention provides a finger safe method of distributing power while at the same time enabling the installer to make uniform and correct connections to a multiplicity of taps or ports. Each connection includes an abutment or seat physically to engage the end of the conductor and in addition the construction of the block and its insulating case provides the installer with visual access to the tip of the conductor in its proper seated position before the conductor is secured to the block. In order to provide such visual access the walls partially blocking the seating end of each conductor socket are scalloped or provided with an inverted conical section which enables the tip of each conductor to be seen from the top of the block. To facilitate this visual access the entire top of the insulating case is made from a transparent material.

21 Claims, 3 Drawing Sheets

U.S. PATENT DOCUMENTS

| | | | | |
|---|---|---|---|---|
| 5,201,678 | A | 4/1993 | Venezia | 439/723 |
| 5,427,550 | A | 6/1995 | Jaag | 439/709 |
| 6,497,592 | B1 * | 12/2002 | Beadle | 439/814 |

FOREIGN PATENT DOCUMENTS

| | | |
|---|---|---|
| EP | 1 107 363 A1 | 6/2001 |
| EP | 1 130 683 | 9/2001 |
| FR | 1 229 880 | 9/1960 |
| FR | 2 746 220 | 9/1997 |
| FR | 2 802 025 | 6/2001 |
| GB | 2 085 672 | 4/1982 |
| GB | 2 387 042 | 10/2003 |

OTHER PUBLICATIONS

*Connector Manufacturing Co.,* Brochure, 1986, pp. 7,8.
*Homac's Zeebar, Compact! Easy to Install!*, no date.
*Electrical System Distribution,* p. 50, 1988.

* cited by examiner

POWER DISTRIBUTION BLOCK ASSEMBLY

DISCLOSURE

This invention relates generally as indicated to a power distribution block assembly and more particularly to a terminal distribution block assembly and method which is finger-safe when energized, whether empty, or at full capacity.

BACKGROUND OF THE INVENTION

In the distribution of electric power, distribution blocks are often employed. These assemblies have widely been used for distributing incoming electrical power to a number of distinct circuits. Applications may vary widely such as power distribution to houses from a common transformer, or in electrical distribution panel boards where the blocks may be mounted on a common rail for distribution in mono-polar or multi-polar applications.

Typically the block includes a connection for a larger conductor cable or bus and a plurality of tap connections for smaller conductors. The bare ends of the conductors are inserted in socket ports or holes and held in place typically by a clamp or binding screw threaded in a hole perpendicular to the socket receiving the conductor.

One of the problems with these types of distribution blocks is that many of the tap connections are added at a later time after the system is in operation and the block energized. To make the connection safely the system may require to be shut down, and this in turn may create a raft of problems, particularly if the power is shut down for any length of time.

In order to protect the block from incidental contact many are enclosed in insulating enclosures or cases which protect the block from direct contact. To make a connection the case may be provided with large windows or ports or even hinged covers which may be opened for access, or the cases may be removed entirely, all of which permits finger contact with the block by the installer.

The use of insulating cases makes the proper installation of primary and tap connections more problematic. In a connection using a typical blind socket port or hole the installer simply inserts the bare or stripped end of the conductor into the socket until resistence is felt and then tightens the binding screw. It may not be determined that an improper connection was made until the power is turned on again or until the connection fails because the bare end of the conductor wasn't properly positioned with respect to the binding screw. The conductor may have hung-up on an obstruction which was not the blind end of the hole or port. If the conductor is inserted too far, the projecting end may interfere with or obstruct something else, and the binding screw may be tightened on insulation. Moreover non-uniform projecting conductors create a mess, particularly when all the taps are used making service and inspection difficult.

It would accordingly be advantageous for the installer to be able to have both the abutment afforded by the blind end of the port and a visual check to see that the conductor is properly inserted or placed before the binding screw is tightened. In this manner, ensured uniform connections can be made for each of the taps, with the ends of the conductors projecting beyond the screws a uniform distance, and not too far or not far enough.

It would also of course be desirable that these uniform tap connections could all be made without turning off the power or opening an insulating case. It would therefore be desirable to be able to make such uniform connections having both the visual and physical abutment check without finger contact with the block and without opening the case. A power distribution block with such connections which is finger-safe once the incoming line is installed is highly desirable.

SUMMARY OF THE INVENTION

The terminal block assembly of this invention provides a finger safe method of distributing power while at the same time enabling the installer to make uniform and correct connections to a multiplicity of taps or ports. Each connection includes an abutment or seat physically to engage the end of the conductor and in addition the construction of the block and its insulating case provides the installer with visual access to the tip of the conductor in its proper seated position before the conductor is secured to the block.

In order to provide such visual access the walls partially blocking the seating end of each conductor socket are scalloped or provided with an inverted conical section which enables the tip of each conductor to be seen from the top of the block. To facilitate this visual access the entire top of the insulating case is made from a transparent material.

The cover is provided with respective holes each accommodating an insulated fastener driver so that the clamp screws may be manipulated or tightened from the exterior of the case.

The case is also provided with alignment galleries or tap port extensions enabling the insulated bare end conductors to be inserted to the proper seated depth in the tap ports without finger contact with the conductive block.

In this manner the terminal or distribution block remains finger-safe while energized from empty to full output capacity while allowing both visual and physical indication of proper conductor placement to make uniform and secure tap connections, avoiding both over or under insertion.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENT

Figure 1:
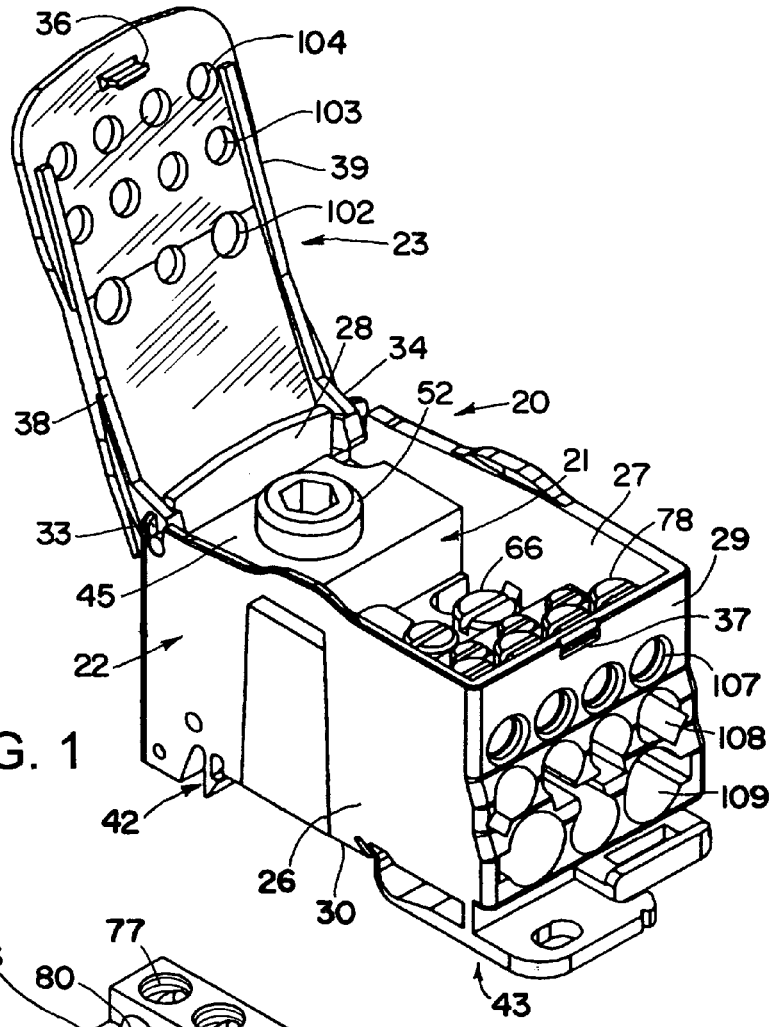
FIG. 1 is a perspective view of one model of a distribution block in accordance with the present invention showing the case transparent cover open and partially exposing the block.

Referring initially to FIG. 1 there is illustrated a power distribution block assembly in accordance with the present invention shown generally at 20. The metal conducting block is shown at 21 while the block is surrounded by insulating case 22 having a hinged top cover 23 shown in the open position.

The metal terminal block 21 shown in detail in FIGS. 2 through 6 is made from conductive metal such as an aluminum alloy and can be extruded and machined. After machining the blocks may then be tin plated to a thickness of approximately 0.05 mm.

The plastic insulation case 22 is preferably made from a plastic such as NYLON. The cover, however, is made of a transparent plastic material such as polycarbonate such as sold by General Electric Company of Schenectady, N.Y. under its trademark LEXAN® 940A. The cover may be tinted a color such as blue, but is nonetheless fully transparent providing visual access to the interior of the case and block when the cover or lid is closed.

As seen in FIG. 1 the case 22 comprises side walls 26 and 27, end walls 28 and 29, and a bottom wall 30 somewhat obscured. The cover 23 may be hinged as indicated at 33 and 34 to the end wall 28 and the cover or lid may be provided with an over-center snap to keep it in the open position shown. The tip of the cover is provided with a snap tang indicated at 36 which seats in snap recess 37 in the top of wall 29. The underside of the cover or lid is provided with two projecting ribs seen at 38 and 39 which telescope inside the top edge of the case 22 blocking access to the interior of the case when the lid or cover is closed. The insulating case is also provided with certain projections from the bottom wall 30 indicated at 42 and 43 to facilitate the mounting of the power distribution block assembly on an electric panel or din-rail. While each individual assembly is a single-pole or mono-pole block, such assemblies may be ganged together by means of the male and female dovetails shown at the sides for convenient distribution in multi-pole systems.

Referring now additionally to FIGS. 2 through 6 it will be seen that the conductive metal terminal block 21 may be formed from an extrusion and then machined and includes a large section at one end shown generally at 45 which includes a large socket 46 in wall 47. Extending normal to the socket is a threaded hole 48 in the top wall 49 of the enlarged end 45. The threaded or tapped hole 48 accommodates large recessed head clamp screw 52 seen in FIG. 1.

The large socket 46 extends through the interior wall 54 of the enlarged end and partially into the reduced height portion 56 of the block 21. This extension of the socket beyond the wall 54 is seen at 58 in FIG. 3.

Situated in the reduced height portion 56 of the block are three tap sockets 60 which open generally to the right hand side of the block as seen in FIGS. 2 through 6. Each of the tap sockets is provided with a transverse threaded opening in the top seen at 62, 63, and 64 for accommodating the clamp screws indicated at 66 in FIG. 1.

Projecting from the reduced height portion 56 of the block is another offset tier of tap ports or sockets shown generally at 70 and projecting from the intermediate tier 70 is a further offset tier 72. The intermediate tier includes four side-by-side sockets or ports for tap connections indicated at 74 while the top tier includes four side-by-side tap connections indicated by the sockets 75. Again, each respective socket or port is provided with a transversely extending threaded hole as seen at 76 for the intermediate tier 70 and 77 for the top tier 72. These tapped holes in the top two tiers accommodate the clamp screws seen at 78 in FIG. 1. It is noted that the socket in a single tier may be the same size or they may vary in size as in the bottom tier.

Figure 2:
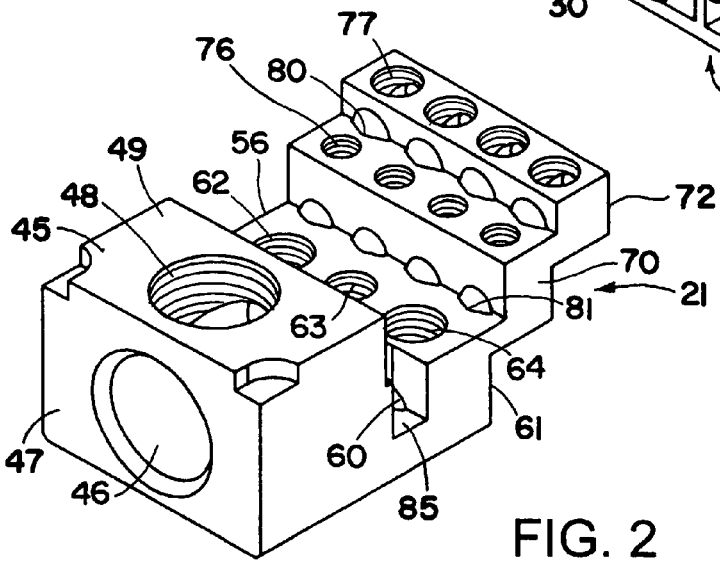
FIG. 2 is a perspective view of the block showing the sight windows in the block at the abutment walls at the inner ends of each tap socket.
Figure 3:
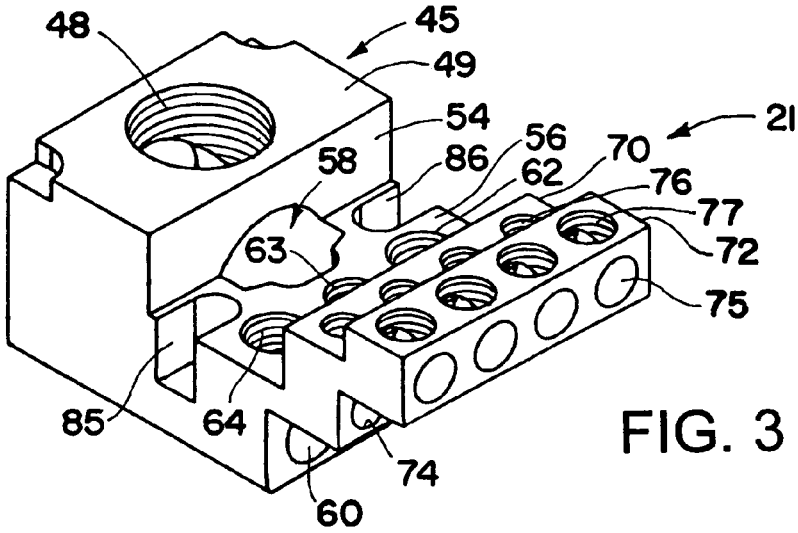
FIG. 3 is a similar perspective of the block from the opposite end showing the tiered tap sockets.
Figure 4:
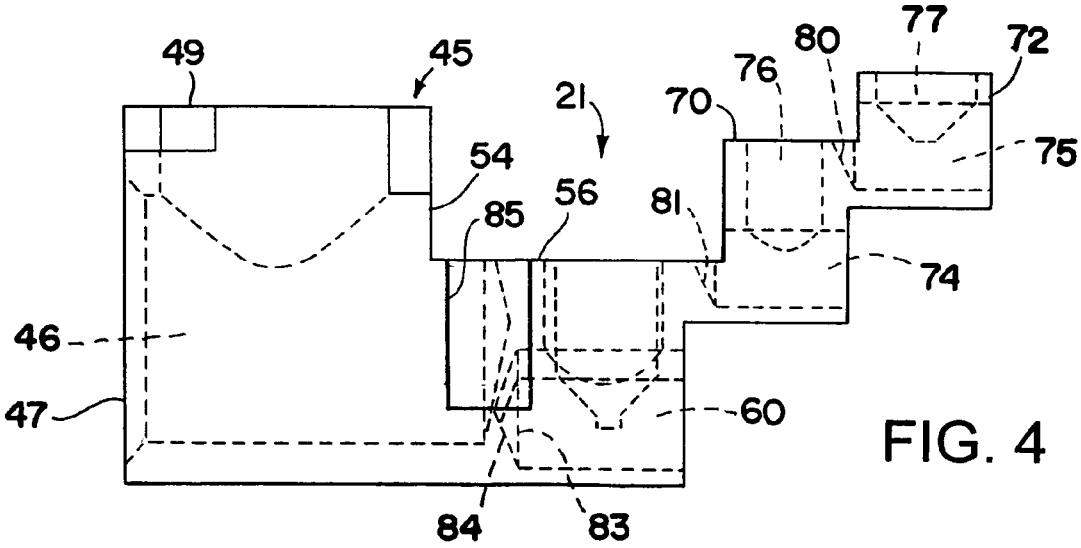
FIG. 4 is an enlarged side elevation of the block.
Figure 5:
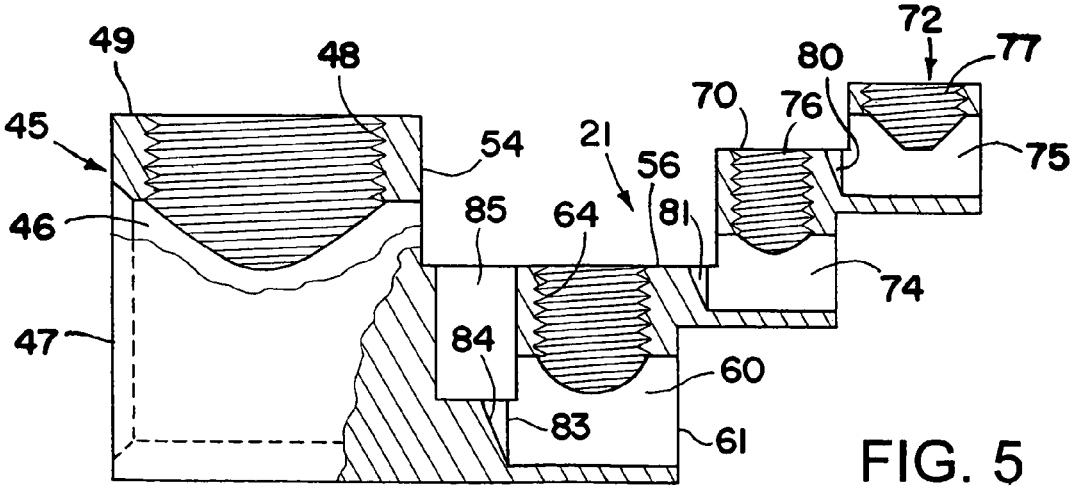
FIG. 5 is an enlarged fragmentary section showing the abutment walls and sight windows.

Referring now more particularly to FIGS. 2 and 5 it will be seen that the sockets 75 in the top tier 72 are partially blocked by the adjoining tier 70 while the sockets 74 in the intermediate tier are partially blocked by the portion of the block of reduced height indicated at 56.

The abutment wall at the end of each of the sockets seen at 74 and 75 is slightly beyond the interior wall of the tier and each abutment end of the socket at such wall is provided with an inverted conic relief or scallop as indicated at 80 for the top tier sockets and 81 for the intermediate tier sockets. The two outside sockets in the lower most tier are partially blocked by the wall 83 which also includes the inverted conic projection or scallop 84 opening into sight windows 85 and 86. These sight windows are formed in the reduced height portion of the block. The center socket in the bottom tier is also provided with an abutment wall partially blocking the interior of the socket and a similar scalloped or inverted conic projection opening into the large socket for the main conductor shown at 46 and 56.

In this manner each of the tap sockets is provided with an internal abutment wall and also a sight window or opening enabling the tip of the conductor inserted into the tap port or socket to be seen from the top of the assembly through the transparent cover 23. The scallops or projections into the abutment walls of the various tap sockets may be formed by an angled drill point and need not be inverted circular conical sections, but may be other shapes as well. In each of the sockets or tap ports, the abutment wall may extend to approximately half the height of the socket opening or diameter and the angle of the conical section may vary at its center from approximately 15 to approximately 40° and, preferably, about 30° from vertical.

Figure 6:
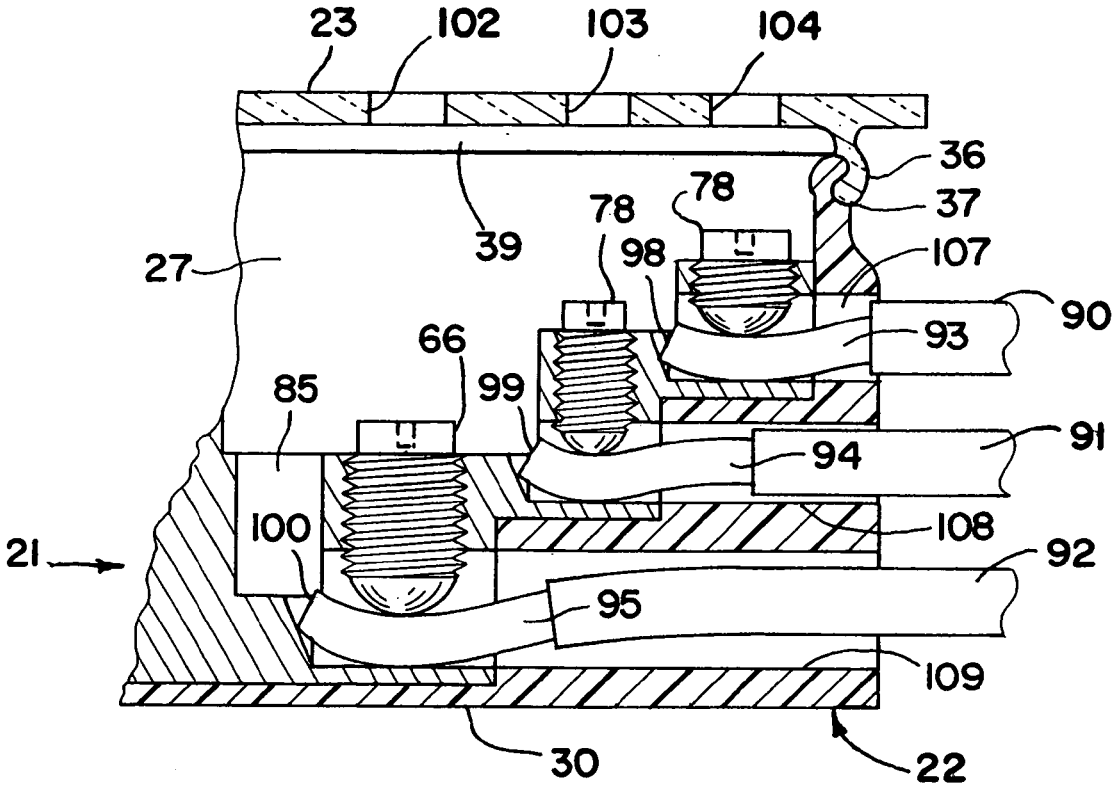
FIG. 6 is an also enlarged fragmentary section showing tap conductors in place and secured to the block.

Referring now to FIG. 6 there is illustrated insulated conductors shown at 90, 91, and 92 inserted in the respective sockets 75, 74, and 60. The tips of the conductors with the insulation removed is seen at 93, 94, and 95 and such tips engage the abutment end of each socket and in such physical contact with the abutment end the tip of the respective bared conductor indicated at 98, 99, and 100 is visible from the top of the assembly through the transparent cover 23. FIG. 6 illustrates the cover with access ports seen at 102, 103 and 104 which are aligned with the clamp screws of the various ports or sockets. As seen more clearly in FIG. 1 the cover or lid is provided with a total of eleven (11) ports, one for each of the various tap connections provided by the block 21.

Also as seen in FIG. 6, the case 22 includes alignment galleries seen at 107, 108, and 109 which assist the installer in insertion of the bared end of the conductor into the socket and also protect against finger insertion into the case.

Accordingly, once the main conductor is inserted and the fastener 52 tightened to activate the block and the cover or lid is closed, the assembly is then finger-safe for installing, one, more, or all of the various tap connections available.

Even though the insulated case is closed, as the installer makes the connection, the installer has the benefit of both the physical abutment or engagement of the tip of the conductor against the abutment wall and the visual access to the tip of the conductor through the transparent lid or top. In this manner all of the tap connections will be both uniform and electrically correct, each with the proper uniform extent of the conductor extending beneath and beyond the clamp screw. The operator then simple inserts an insulated tool through the respective access openings 102, 103, or 104 to tighten the clamp screw on the properly positioned conductor bare end.

Although not illustrated, it will be appreciated that once the tap conductors are stripped to the specified length they may be installed first in a ferrule placed over the stripped end portion of the conductor. The conductor or ferrule will then proceed to the abutment or bottom of the tap hole that is partially visually exposed and visible through the transparent cover. This visual indication of the conductor placement ensures that the installer has both the physical abutment available as well as a visual check to make sure the conductor is properly in place before the fastener is secured.

Figure 7:
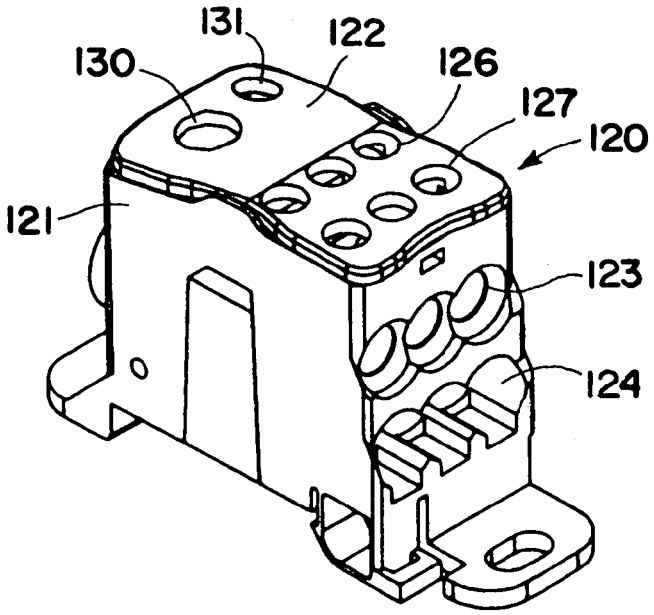
FIG. 7 is a perspective view of another form of terminal block assembly in accordance with this invention.

Referring now to the embodiment of FIG. 7 there is illustrated a slightly smaller version of the terminal block assembly of the present invention. The embodiment shown generally at 120 includes an insulated case 121 with a transparent cover 122. The block within the case isn't shown but the case is provided with alignment galleries shown at 123 and 124 to enable the bared conductor ends with or without ferrules to be inserted into the tap receiving sockets. The clamp screw of each tap receiving socket is provided with an access port in the cover or lid as seen at 126 or 127.

It is noted that the cover of the embodiment of FIG. 7 is provided with a somewhat larger hole 130 which provides access to the clamp screw for the main conductor. The cover is also provided with a somewhat smaller hole 131 providing access to a clamp screw for another tap. In the smaller version illustrated, the transparent cover 122 for the case may be fixed with the somewhat larger access opening 130 provided for the incoming line. This is in contrast to the larger embodiment of FIG. 1 where the large fastener 52 for the incoming line has no access opening in the hinged cover.

Whether the larger or smaller version of the present invention, both are provided with transparent covers or lids which provide visual access through the sight windows to the tips of the conductors with or without ferrules inserted in the various tap ports or sockets against the abutment walls forming the inner ends of such sockets. The present invention provides a large capacity for power distribution but at a low cost and in a finger-safe manner enabling the installer to make uniform proper connections avoiding over or under insertion of the tap connections.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

The invention claimed is:

1. A terminal block for electric distribution comprising a main port for a main power conductor and a series of tap ports for distribution of power, the main and tap ports comprising seating sockets with transversely extending clamp screws adapted to secure conductors seated in the sockets, an insulating case for said block having a transparent cover providing visual access to the tip of said conductors, respective ports in said case for inserting conductors fully seated in said respective ports, and ports in said cover providing access to said clamp screws whereby conductors may be inserted fully seated in said ports and secured with said clamp screws without contact with the block.

2. A terminal block as set forth in claim 1 including window openings in said block at the seating end of each port to enable the tip of each conductor inserted to be viewed through the transparent cover.

3. A terminal block as set forth in claim 2 wherein said transparent cover may be hinged to said insulating case.

4. A terminal block as set forth in claim 3 including respective limiting ports in said cover for each said clamp screw enabling an insulated tool to be inserted with close clearance for operation of the respective screw but precluding finger insertion.

5. A terminal block as set forth in claim 4 including respective ports in said case for each of the tap ports in said block enabling a bare conductor end to be inserted into the respective port to full seating against the seating end of the port.

6. A terminal block as set forth in claim 5 including alignment galleries in said case to facilitate the insertion of said conductors in said tap ports.

7. A terminal block as set forth in claim 2 wherein said tap ports are arranged in offset rows and the seating end of the ports of at least one row are partially blocked by an adjoining row.

8. A terminal block as set forth in claim 7 wherein the wall of the block partially blocking the seating end of each port is formed with an inverted conical surface to facilitate the installer visually checking the position of the tip of the conductor when seated in the port.

9. A terminal block is set forth in claim 8 wherein the angle of the wall at the center of the conical surface is about 30 transverse of the axis of the port.

10. A terminal block as set forth in claim 8 wherein the wall blocking the seating end of the tap port extends far enough to prevent over insertion of the conductors.

11. An electric distribution terminal block comprising a conductive block having a main power connection in one side and smaller tap connections in another side, each connection comprising a socket to receive the conductor with a blocking abutment at the inner end to ensure proper insertion and to prevent over insertion, and a transverse clamp screw to secure the conductor in the socket when tightened, and an opening at the abutment end of each socket to provide visual access to the end of the conductor when inserted properly against the abutment in the socket.

12. An electric distribution terminal block as set forth in claim 11 including an insulating case for said block, and a transparent window in said case to provide the installer such visual access from outside the case.

13. An electric distribution block as set forth in claim 12 wherein said transparent window is opposite the openings at the abutment end of each socket.

14. An electric distribution block as set forth in claim 13 wherein said transparent window is the top of the case.

15. An electric distribution block as set forth in claim 14 wherein said top may be hinged to the case.

16. An electric distribution block as set forth in claim 15 including respective ports in said top of said case providing limited access to the respective clamp screws.

17. An electric distribution block as set forth in claim 16 including additional respective ports in said insulating case to enable bare conductor ends to be inserted into the respective socket against the abutment.

18. An electric distribution block as set forth in claim 17 including alignment galleries in said case to facilitate the insertion of said bare conductor ends into said sockets.

19. An electric distribution block as set forth in claim 16 wherein said sockets are arranged in offset rows with the inner end of the sockets of at least one row being partially blocked by the adjoining row.

20. An electric distribution block as set forth in claim 16 including a wall of the block partially blocking the inner end of each socket to prevent over insertion of the ends of the conductors.

21. An electric distribution block as set forth in claim 20 wherein the blocking wall of each socket is formed with a generally inverted conical surface.

* * * * *